United States Patent [19]

Kadija

[11] 4,032,427

[45] June 28, 1977

[54] POROUS ANODE SEPARATOR

[75] Inventor: Igor V. Kadija, Cleveland, Tenn.

[73] Assignee: Olin Corporation, New Haven, Conn.

[22] Filed: Nov. 3, 1975

[21] Appl. No.: 627,995

[52] U.S. Cl. ..... 204/283; 204/284; 204/290 F; 204/295

[51] Int. Cl.[2] ..... C25B 11/06; C25B 13/04

[58] Field of Search ..... 204/290 R, 290 F, 283, 204/284, 295

[56] References Cited

UNITED STATES PATENTS

| | | | |
|---|---|---|---|
| 3,222,265 | 12/1965 | Beer | 204/1 |
| 3,458,423 | 7/1969 | Csizi | 204/219 |
| 3,491,014 | 1/1970 | Bianchi et al. | 204/242 |
| 3,562,008 | 2/1971 | Martinsons | 427/126 |
| 3,661,739 | 5/1972 | Tourilov et al. | 204/73 A |
| 3,775,284 | 11/1973 | Bennett et al. | 204/290 F |
| 3,878,083 | 4/1975 | DeNora et al. | 204/290 F |

FOREIGN PATENTS OR APPLICATIONS

| | | | |
|---|---|---|---|
| 1,221,380 | 7/1966 | Germany | 204/284 |

*Primary Examiner*—F.C. Edmundson
*Attorney, Agent, or Firm*—James B. Haglind; Donald F. Clements; Thomas P. O'Day

[57] ABSTRACT

A porous anode separator for an electrolytic cell for the electrolysis of alkali metal chloride solutions comprises a porous valve metal plate having an electrochemically active coating on the face and a barrier layer on the back and on a portion of the interior. The barrier layer comprises a mixture of a valve metal oxide with a ceramic oxide. Suitable ceramic oxides include those of silicon, aluminum, magnesium, and calcium. The electrochemically active coating comprises a platinum group metal or metal oxide. The porous anodes provide improved gas separation and permit a substantial reduction in the amount of platinum group metal required for the electrochemically active coating.

15 Claims, 3 Drawing Figures

POROUS ANODE SEPARATOR

This invention relates to electrodes for use in electrolytic cells. More particularly, this invention relates to porous metal anodes for use in electrolytic cells for producing gaseous products.

It is known to employ porous metal diaphragms in electrolytic cells. U.S. Pat. No. 3,222,265, issued to H. B. Beer describes a porous metal diaphragm consisting of a porous plate of titanium having a thin layer of a noble metal on one side and a barrier layer of titanium dioxide on the other side. The pores in the diaphragm were substantially perpendicular to the faces of the plate. The diaphragm had a thickness of a fraction of a millimeter and could be used as an anode by applying current along the side of the plate coated with the noble metal.

The diaphragm of U.S. Pat. No. 3,222,265 having rectilinear pores was produced, for example, by etching the titanium plate or mechanically perforating the plate. The resulting diaphragm is a fragile structure having limited gas separation properties. In addition, there is little control over the amount of penetration of the noble metal coating into the porous plate. The rectilinear pores have no means for preventing gas flow back through the porous structure.

Therefore there is a need for a porous anode having improved gas separation properties, improved porosity and reduced penetration of the noble metal coating into the porous interior of the anode. In addition, there is need for a porous anode which will prevent gas flow in an undesired direction and which can be produced at reduced cost.

It is an object of the present invention to provide a porous anode having improved separation of the electrochemically active area from the electrochemically non-active area.

It is a further object of the present invention to provide a porous anode having improved porosity.

An additional object of the present invention is a porous anode having improved gas separation properties.

These and other objects of the invention are accomplished in an anode separator comprising a porous plate of a valve metal, said porous plate having a face, a back and an interior structure. The face has an electrochemically active coating which is selected from the group consisting of a platinum group metal, a platinum group metal oxide, and mixtures thereof. The back and at least 10 percent of the interior structure have a barrier layer comprising a mixture of a valve metal oxide and a ceramic oxide. The ceramic oxide is selected from the group consisting of silicon oxide, aluminum oxide, magnesium oxide, calcium oxide and mixtures thereof.

Figure 1:
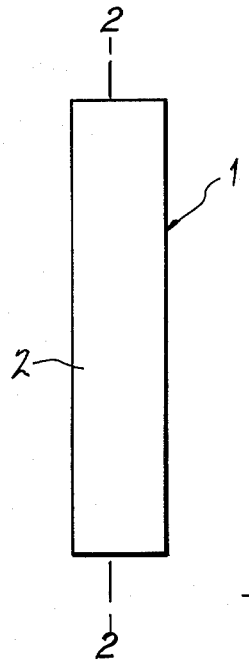

FIG. 1 represents a side view of porous anode separator 1.

Figure 2:
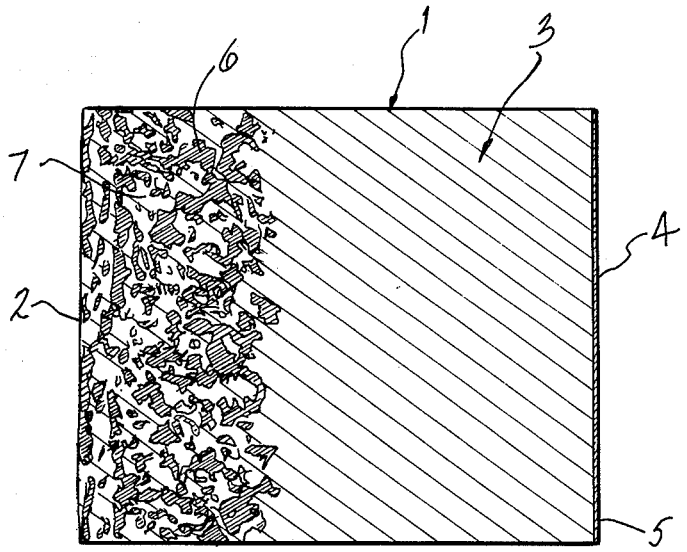

FIG. 2 depicts a cross section of porous anode separator 1 taken along line 2—2 of FIG. 1. Porous anode separator 1 has a face 4, a back 2 and an interior structure 3. Face 4 is coated with electroactive coating 5. Back 2 and a portion of interior structure 3 have a barrier layer which is a mixture of ceramic oxide 6 and a valve metal oxide 7.

A porous plate of a valve metal is used in the novel anode of the present invention. The plate has a thickness of from about one-twenty-fourth to about three-eighths of an inch, preferably from about one-sixteenth to about one-fourth of an inch, and more preferably from about one-sixteenth to about one-eighth of an inch. While plates having a thickness greater than three-eighths of an inch may be used, they have less desirable separation properties.

A suitable porosity of the porous plate is that of from about 30 to about 75 percent. The porosity is defined as the ratio of the void to the total volume of the porous plate. A preferred porosity is from about 40 to about 70 percent. Any convenient pore size may be used for example, from about 5 microns to about 500 microns, preferably from about 10 to about 100 microns, and more preferably from about 25 to about 50 microns. The porosity can be random as no particular directional orientation is required, but it is preferred that the porosity be uniform throughout the porous plate.

Porous plates of valve metals are available commercially or can be produced by a process such as sintering a metal in powder form.

Where improved mechanical strength is desired for the porous plate, for example, for anodes having a large surface area, the interior of the plate may include a foraminous structure of the valve metal such as an expanded mesh or net or a perforated plate. The foraminous structure is enveloped by the porous plate. A mesh reinforced valve metal plate is commercially available, for example, from Gould, Inc.

For the purposes of this specification, a valve metal is a metal which, in an electrolytic cell, can function generally as a cathode, but not generally as an anode as an oxide of the metal forms under anodic conditions. This oxide is highly resistant to the passage therethrough of electrons.

Suitable valve metals include titanium, tantalum, or niobium, with titanium being preferred.

The porous plate is coated on the back and a portion of the interior with a barrier layer which serves as the electrochemically non-active layer. The barrier layer comprises a mixture of a valve metal oxide with a ceramic oxide. A valve metal oxide is an oxide of titanium, tantalum or niobium where the valve metal is defined as above. A preferred valve metal oxide is titanium oxide. The ceramic oxide is selected from the group consisting of silicon oxide, aluminum oxide, magnesium oxide, and calcium oxide. The barrier layer may be formed by any suitable method. For example, the ceramic oxide may be applied to the back and interior of the porous plate as a dispersion or solution. The coating is applied to the base in a manner which will permit the ceramic oxide to permeate the porous inner structure of the anode, but will not coat the face, that is the side which will have an electrochemically active coating. The porous plate may then be heated to a temperature of from about 400° C. to about 800° C. in an oxygen-containing atmosphere to form the barrier layer comprising a mixture of the valve metal oxide and the oxide of Si, Mg, Ca or Al, or mixtures thereof. In addition to the oxides themselves, any suitable compounds may be used in preparing the ceramic oxide portion of the barrier layer. For example, silica-containing compositions or silicone rubber may be used to provide silicon oxide while $MgCO_3$ or $Mg(OH)_2$, $CaCO_3$ or $Ca(OH)_2$ or $Al(OH)_3$ may similarly be used to prepare the oxides of Mg, Ca or Al, respectively. Where mixtures of oxides are desired, the compounds of Mg, Ca or Al may be mixed with, for example, a silicone rubber composition and the mixture applied to the back and the interior of the porous anode separator. If desired, a solvent such as hexane may be added to the mixture to provide increased permeation through the interior portion of the anode separator.

In another embodiment, a valve metal oxide may be added to the ceramic oxide in forming the barrier layer.

The barrier layer thickness on the back of the porous anode separator is not critical and any suitable thickness may be employed which is electrochemically nonreactive with respect to the alkali metal chloride solution.

To serve as an effective separator, at least about 10 percent of the interior structure should be coated by the barrier layer mixture. For example, a satisfactory anode separated is obtained by coating a proportion of from about 10 percent to about 90 percent of the interior structure with the barrier layer. A preferred proportion is from about 30 to about 60 percent of the interior structure of the porous plate.

As a component of the mixture, the ceramic oxide is present in amounts of from about 10 percent to about 70 percent by volume of the total mixture. Preferably, the ceramic oxide constitutes from about 20 percent to about 40 percent by volume of the total mixture. While any of the ceramic oxides may be suitably used in the barrier layer of the novel anode separator of the present invention, silicon oxide and aluminum oxide are preferred, with silicon oxide being most preferred.

The face of the porous titanium plate is coated with a platinum group metal or platinum group metal oxide or mixtures thereof using any of several well known procedures, as described, for example, in U.S. Pat. No. 3,630,768, issued to Bianchi et al., U.S. Pat. No. 3,853,739, issued to Kolb et al., U.S. Pat. No. 3,773,555, issued to Cotton et al., or U.S. Pat. No. 3,578,572, issued to Lee. The term "platinum group metal" as used in the specification means an element of the group consisting of ruthenium, rhodium, palladium, osmium, iridium, and platinum.

Where the electrochemically active coating includes a platinum group metal oxide, the oxidation procedure used to form the barrier layer can be employed simultaneously to form the platinum group metal oxide.

Any suitable thickness may be used for the electrochemically active coating providing the coating is present in an amount sufficient to function effectively as an anode in the electrolysis of alkali metal chloride solutions. It has been found, however, that a considerable reduction in the amount of platinum group metal or platinum group metal oxide required is achieved when employing the novel porous anode of the present invention. For example, loading amounts of the platinum group metal or metal oxide can be reduced by over 50 percent below those used in coating non-porous anodes of titanium or tantalum.

While any suitable portion of the face of the porous anode plate may be coated with the electrochemically active coating, it is preferred that the electrochemically active coating essentially cover the anode face.

In another embodiment, the electrochemically active coating may be made partly hydrophobic by applying a coating of a polymeric material such as polytetrafluoroethylene, for example, by spraying or painting over a portion of the face of the porous anode.

The anodes of the present invention find application in the electrolytic production of chlorine and alkali metal hydroxides or alkali metal chlorates when employed in electrolytic cells known in the art. The anodes of the present invention are particularly suited for use in electrolytic diaphragm cells.

The following example is presented to further illustrate the invention without any intention of being limited thereby. All parts and percentages are by weight unless otherwise specified.

EXAMPLE

A commercially available porous titanium plate 1/16 of an inch thick and having a porosity of 60 percent and an average pore size of 25 microns was coated on one side with a thin protective coat of silicone rubber (General Electric Co. RTV-102). The silicone rubber penetrated the interior of the porous plate, but was prevented from coating the face of the plate. The rubber coated side was cured at room temperature over a 2 hour period. The face or uncoated side of the porous titanium plate was then painted with a 10 percent solution of $RuCl_4$ in 0.1N HCl. The plate was then baked in an oven at 400° C. for 5 minutes. Following cooling, the face was recoated with the $RuCl_4$ solution and the porous plate then heated in an oven having an air atmosphere for about 6 hours at 400° C. During this heating, the silicone rubber coated titanium was oxidized and a mixture of silicon dioxide and titanium dioxide formed on the back and throughout the porous structure of the plate. An electrochemically active coating of ruthenium dioxide formed on the front of the plate. Photomicrographs obtained using a scanning electron microscope established that the silicon dioxide was evenly distributed throughout the barrier layer as a mixture with titanium dioxide containing about 30 percent by volume of $SiO_2$. The barrier layer mixture covered about 50 percent of the interior structure of the porous plate.

The overpotential characteristics of the anode of the Example were determined by connecting the anode in an electrolytic cell containing a cathode, a reference electrode and sodium chloride, at a temperature of 25° C., as the electrolyte. The anode-cathode gap was about 1cm. A Luddin capillary was used to measure the overpotential of the anode using a capillary-anode gap of about 1mm. Electrolysis of the sodium chloride was conducted at the following current densities and the overpotential determined.

| Current Density | Overpotential of Anode Separator of Example (In millivolts) |
|---|---|
| 0.1 | 35 |
| 1.0 | 55 |
| 3.0 | 75 |
| 5.0 | 95 |
| 10.0 | 125 |

The anode separator was thus shown to function as an anode in the electrolysis of sodium chloride. It was visually observed that the chlorine gas formed only at the face of the anode having the electrochemically-active coating.

What is claimed is:

1. An anode separator comprising a porous plate of a valve metal selected from the group consisting of titanium, tantalum and niobium, said porous plate having a face, a back and an interior structure, said face having an electrochemically active coating selected from the group consisting of a platinum group metal, a platinum group metal oxide and mixtures thereof, said back and a portion of said interior having an electrochemically non-active barrier layer comprising a mixture of an oxide of titanium, tantalum or niobium and a ceramic oxide selected from the group consisting of silicon oxide, aluminum oxide, magnesium oxide, calcium oxide, and mixtures thereof, wherein said portion is at least 10 percent of said interior structure.

2. The anode separator of claim 1 wherein said ceramic oxide is silicon oxide.

3. The anode separator of claim 1 wherein said valve metal is titanium and said porous plate has a thickness of from about one-twenty-fourth to about three-eighths of an inch.

4. The anode separator of claim 3 wherein said porous plate has a porosity of from about 30 percent to about 75 percent.

5. The anode separator of claim 4 wherein said porous plate has a pore size of from about 5 microns to about 500 microns.

6. The anode separator of claim 4 wherein said valve metal oxide is selected from the group consisting of titanium oxide and tantalum oxide.

7. The anode separator of claim 6 wherein said ceramic oxide is silicon oxide.

8. The anode separator of claim 6 wherein said ceramic oxide is a mixture of silicon oxide and aluminum oxide.

9. The anode separator of claim 7 wherein said electrochemically active coating is a platinum group metal oxide selected from the group consisting of platinum oxide, palladium oxide, iridium oxide, ruthenium oxide, rhodium oxide and osmium oxide.

10. The anode separator of claim 9 wherein said electrochemically active coating is ruthenium oxide.

11. The anode separator of claim 10 wherein said valve metal oxide is titanium oxide.

12. The anode separator of claim 1 wherein said portion of said interior structure having said barrier layer is from about 10 to about 90 percent.

13. The anode separator of claim 10 wherein said porous plate has a foraminous structure of a valve metal enveloped by said porous plate.

14. The anode separator of claim 13 wherein said foraminous structure is an expanded mesh.

15. The anode separator of claim 14 wherein said valve metal is titanium.

* * * * *